United States Patent [19]

Claassen

[11] 4,342,164

[45] Aug. 3, 1982

[54] COUNTERBALANCING HYDRAULIC SYSTEM

[75] Inventor: Josephus A. M. Claassen, Nuenen, Netherlands

[73] Assignee: Hydraudyne B.V., Boxtel, Netherlands

[21] Appl. No.: 82,745

[22] Filed: Oct. 9, 1979

Related U.S. Application Data

[63] Continuation of Ser. No. 891,768, Mar. 30, 1978, abandoned.

[51] Int. Cl.[3] ..... E02F 9/22; F15B 13/06; F15B 13/09

[52] U.S. Cl. ..... 37/73; 60/475; 60/476; 60/486

[58] Field of Search ..... 37/73, 54, 64, 65; 137/567; 60/473, 475, 476, 484, 486, 567, 571, 572, 581; 417/315; 91/170, 520; 92/146

[56] References Cited

U.S. PATENT DOCUMENTS

| | | | |
|---|---|---|---|
| 890,470 | 6/1908 | Taft et al. | 37/54 X |
| 2,640,323 | 6/1953 | McLeod | 60/475 |
| 2,716,995 | 9/1955 | Baugh et al. | 60/476 X |
| 2,940,262 | 6/1960 | Pfitzenmeier | 91/520 |
| 2,960,828 | 11/1960 | Gould | 60/368 |
| 4,033,056 | 7/1977 | Demmers | 37/73 |

FOREIGN PATENT DOCUMENTS

| | | | |
|---|---|---|---|
| 1112697 | 11/1955 | France | 60/486 |
| 148685 | 9/1968 | Netherlands . | |

*Primary Examiner*—Irwin C. Cohen
*Attorney, Agent, or Firm*—John P. Snyder

[57] ABSTRACT

A counterbalancing hydraulic system for exerting a torque on a member such as a spud pile by means of at least two substantially identical hydraulic cylinders, piston rods of which engage the pile at a distance from one another, the pistons being subjected to pressure in opposite senses, while the portion of each cylinder remote from the piston rod communicates through a main displacer pump motor each with the portion of the other cylinder located on the side of the piston rod and the portion of each cylinder remote from the piston rod communicates through an auxiliary displacer pump motor with a medium reservoir.

3 Claims, 2 Drawing Figures

COUNTERBALANCING HYDRAULIC SYSTEM

This is a continuation of application Ser. No. 891,768 filed Mar. 30, 1978, now abandoned.

The invention relates to a hydraulic system for exerting and displacing a torque on an arm. According to the invention this is achieved by means of at least two substantially identical hydraulic cylinders, piston rods of which engage the arm at a distance from one another, the pistons being subjected to pressure in opposite senses, whilst the portion of each cylinder remote from the piston rod communicates through a main displacer pump motor each with the portion of the other cylinder located on the side of the piston rod and the portion of each cylinder remote from the piston rod communicates through an auxiliary displacer pump motor with a medium reservoir.

Displacement relative to the member while maintaining the torque does, theoretically, not require power. When sliding out or withdrawing the pistons in the same sense in order to effect displacement, power need only be supplied for overcoming friction losses and the force exerted on the member, as the case may be. Therefore, the pump motors may be of the comparatively low power type.

The ratio between the stroke volumes of a main pump motor and an associated auxiliary pump motor is chosen so that the sum of the said volumes relates to the volume of said main pump motor as the ratio between the surfaces of the piston on the side remote from and on the side facing the piston rod. In this way it is ensured that invariably the correct quantity of medium for effecting the displacement is conveyed from one cylinder to the other. The pump motors may be driven by a common driving device. The driving device may be of the hydraulic type.

The hydraulic system according to the invention may be advantageously employed on a cutter dredger provided with a spud pile. The spud pile is rotatably arranged on the common axle of a set of wheels, one piston rod of a hydraulic system according to the invention applying force on one side of the point of rotation and the other piston rod applying force on the other side thereof, whereby to produce the torque couple. In this case, displacement of the dredger relative to the spud requires only such a quantity of power that friction losses and the force exerted by the spud pile on the axle are overcome.

It should be noted that Dutch patent specification 148,685 discloses a hydraulic system comprising a cylinder, the two cylinder compartments of which are coupled by a main displacer pump, whereas the cylinder compartment located on the side of the piston having the larger surface communicates through an auxiliary pump with a medium reservoir.

The invention will be described more fully with reference to the drawings.

Figure 1:
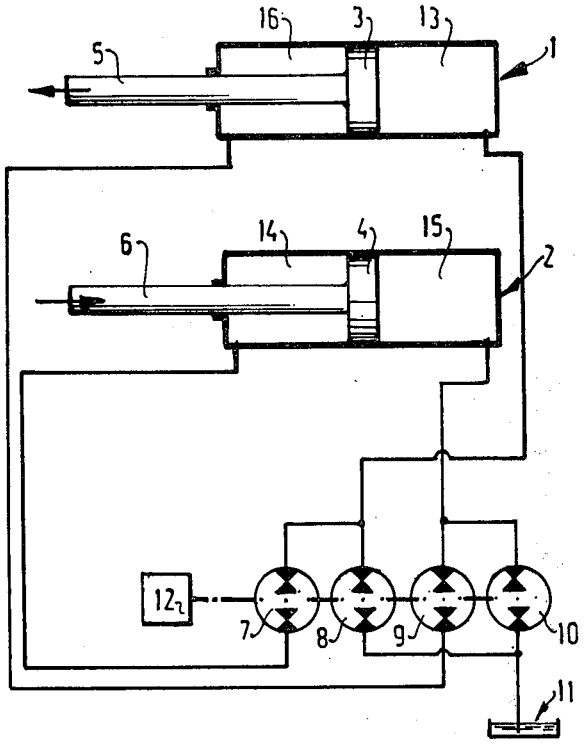
FIG. 1 shows schematically a hydraulic system embodying the invention.

The hydraulic system according to the invention comprises a cylinder 1 and a cylinder 2 having each a piston 3 and 4 respectively and a piston rod 5 and 6 respectively connected with the piston. The cylinder compartment 13 in the cylinder 1 on the side of the piston 3 remote from the piston rod 5 communicates through a main displacer pump motor 7 with the cylinder compartment 14 of the cylinder 2 located on the side of the piston rod 6 of the piston 4. Moreover, the cylinder compartment 13 communicates through an auxiliary pump motor 8 with a medium reservoir 11. In a similar manner the cylinder compartment 15 communicates through a main displacer pump motor 9 with the cylinder compartment 16, whereas the cylinder compartment 15 furthermore communicates through the auxiliary pump motor 10 with the medium reservoir 11. By exerting a force on the piston rods 5 and 6 in the direction indicated by the arrows, the system can produce a torque or compensate for a torque exerted respectively. In order to displace the torque the piston rods 5 and 6 are slid out or drawn in. Upon displacement of the piston 3 in the direction of the arrow medium is supplied to the cylinder compartment 13 and medium is conducted away from the cylinder compartment 16. The volumes of the supplied medium have, of course, a ratio equal to the ratio between the piston surface directed towards the cylinder compartment 13 and the annular piston surface directed towards the cylinder compartment 16. The pump motor 7 can supply only part of the required quantity of medium to the compartment 13, the remainder being completed by the pump motor 8 from the reservoir 11. Upon a movement in the reverse sense the excess medium is conducted away by the pump motor 8 to the reservoir 11. The system operates satisfactorily when the ratio of the stroke volumes of the pump motors 7 and 8 relative to stroke volume of the pump motor 7 is equal to the ratio of the piston surface on the side of the cylinder compartment 13 relative to the annular piston surface on the side of the cylinder compartment 16. A similar ratio has also to be chosen for the stroke volumes of the pump motors 9 and 10. The cylinder compartment 16, like the cylinder compartment 15 is subjected, in the situation shown, to a comparatively high pressure, whereas the compartments 13 and 14 are exposed to a comparatively low pressure. Consequently, for displacing the pistons the pump motor 7 need supply only low power in the direction indicated, since the pressure on the suction side is equal to that on the compression side. The replenishment of medium with the aid of pump motor 8 from the reservoir 11 also requires little energy, since the pressure in the compartment 13 is comparatively low. In fact, this pressure is higher than that in the reservoir, but the difference is slight. The pump motor 9, however, has to supply power, since the pressure in the cylinder compartment 16 exceeds that prevailing in the cylinder compartment 15. Indeed, the forces supplied by the pistons are equal, but owing to the difference in areas on opposite sides of the pistons, 15 the pressure in the cylinder compartment 16 will be higher than that in the cylinder compartment in order to provide the same force. Therefore, on the suction side of pump motor 9 the pressure is higher than on the compression side. The pump 10 supplies medium to the cylinder compartment 15 and has a very low pressure on the suction side and a higher pressure on the compression side. Therefore, the pump motor 10 also supplies power.

It will be obvious that by the system according to the invention a torque can also be supplied in the other direction.

Figure 2:
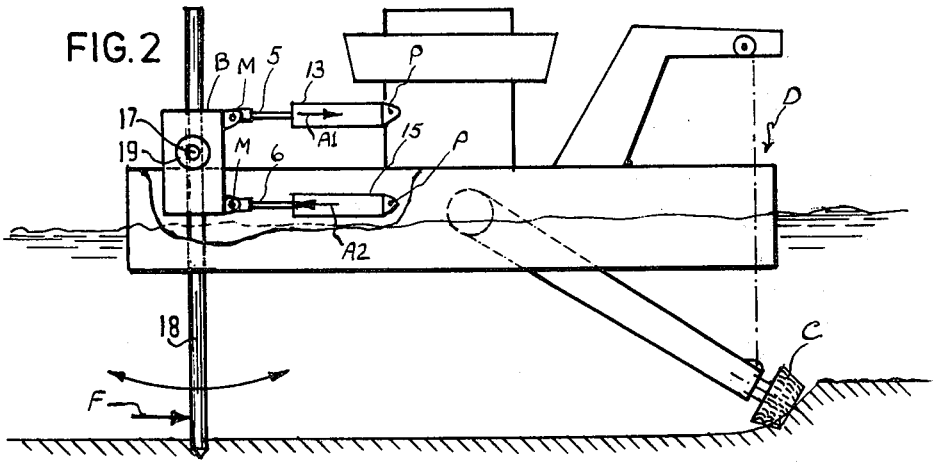
FIG. 2 shows schematically the application of the invention to a cutter dredger with a spud pile.

In FIG. 2, the invention is shown in conjunction with a dredging vessel D which is anchored by means of the spud pile 18, and in this particular application of the invention, the hydraulic system shown in FIG. 1 is used to couple the vessel to the speed pile 18. For this purpose, the cylinders 13 and 15 are pivotally connected, as at P, to the vessel whereas their piston rods 5 and 6 are pivotally connected, as at M, to the body B through which the spud pile 18 extends. An axle 17 projects from the opposite sides of the body B and each end carries a wheel, one of which is indicated at 19. These wheels bear upon the deck of the vessel and allow the body B, and consequently the spud pile 18, to rotate relative to the vessel about the axis of the axle 17. One piston rod is connected to the body B above such axis while the other is connected to the body below such axis, as shown. Thus, if the piston/cylinder assemblies 13,15 are hydraulically "locked" as indicated in FIG. 1, if the vessel D is subjected to forces (i.e., tide or current) which tend to move it to the left in FIG. 2, such movement will be resisted by the forces $A_1$ and $A_2$ as illustrated in FIG. 2. That is, the piston/cylinder 13 will exert or react with a pulling force $A_1$ on the spud pile above the axis 17 whereas the assembly 15 will push against the spud pile below the axis 17. Now, if the drive means 12 (FIG. 1) is actuated to extend the two assemblies 13, 15, the vessel will be moved to the right in FIG. 2 while maintaining the torque couple $A_1$, $A_2$. In the example shown the spud pile exerts a moment which can be compensated for by the hydraulic system, since the upper cylinder exerts a tensile force and the lower cylinder exerts a pressing force on the spud pile. The hydraulic system according to the invention supplies a moment compensating for the moment exerted by the spud pile for translating the dredger relative to the pile. During translation the moment has to be displaced, which is, in principle, performed without the need for energy. The sole power to be supplied from without to the hydraulic system serves for compensating the friction forces and the displacement of the force exerted by the ground on the spud pile, which may, in practice, be 100 tons.

What I claim is:

1. A hydraulic system for resisting a torque couple exerted by a common output member while selectively producing displacement between the common output member and a common base for the hydraulic system while maintaining said torque couple, said common output member having a first end portion anchored in position and an opposite second end portion, which system comprises in combination:

a pair of piston/cylinder devices disposed in parallel and interconnecting said common base and the second end portion of said common output member, each device comprising a cylinder having a piston reciprocable therein and a piston rod connected to said piston whereby each device has a first cylinder space opposite said piston rod and a second cylinder space on the piston rod side of said piston in which said first cylinder space is of greater cross sectional area than is said second cylinder space by an amount equal to the cross sectional area of the piston rod;

a reservoir of hydraulic fluid;

a first pump connected directly between said first cylinder space of said one device and the second cylinder space of the other device for transferring hydraulic fluid back and forth between the first cylinder space of one device and the second cylinder space of the other device;

a second pump connected directly between the first cylinder space of the other device and the second cylinder space of said one device for transferring hydraulic fluid back and forth between the first cylinder space of said other device and the second cylinder space of said one device;

a third pump connected directly between said reservoir and the first cylinder space of said one device for transferring hydraulic fluid back and forth between said reservoir and said first cylinder space of said one device;

a fourth pump connected directly between said reservoir and said first cylinder space of said other device for transferring hydraulic fluid back and forth between said reservoir and said first cylinder space of said other device;

means for operating all of said pumps in unison whereby as said first pump transfers fluid from said second cylinder space of said other device to the first cylinder space of said one device, and third pump transfers fluid from said reservoir to said first cylinder space of said one device, said second pump transfers fluid from said second cylinder space of said one device to the first cylinder space of said other device, and said fourth pump transfers fluid from said reservoir to the first cylinder space of said other device, and vice versa; and all of said pumps being of the displacer pump motor type and the displacement ratio of said first and third pumps and of said second and fourth pumps being such that said piston rods are extended and retracted in unison without altering the torque couple resisted by the hydraulic system.

2. A hydraulic system as defined in claim 1 wherein said common base is a dredger vessel and said common output member is a spud pile.

3. A hydraulic system for maintaining an exerted torque couple on a common output member while selectively displacing the common output member with respect to a common base for the hydraulic system, said common output member having a first end portion anchored in position and an opposite second end portion, which hydraulic system comprises in combination:

a pair of substantially identical piston/cylinder devices, disposed in parallel and interconnecting said common base and the second end portion of said common output member, each device comprising a cylinder having a piston reciprocable therein and a piston rod connected to said piston whereby each device has a first cylinder space opposite said piston rod and a second cylinder space on the piston rod side of said piston in which said first cylinder space is of greater cross sectional area than is said second cylinder space by an amount equal to the cross sectional area of the piston rod;

a reservoir of hydraulic fluid;

a first main pump operable in a first condition to transfer hydraulic fluid from the first cylinder space of one device directly to the second cylinder space of the other device and in a second condition to transfer hydraulic fluid directly from the second cylinder space of said other device to the first cylinder space of said one device;

a second main pump operable in a first condition to transfer hydraulic fluid from the first cylinder space of said other device directly to the second cylinder space of said one device and in a second condition to transfer hydraulic fluid directly from the second cylinder space of said one device to the first cylinder space of said other device;

a first auxiliary pump operable in a first condition to transfer hydraulic fluid from the first cylinder space of said one device to said reservoir and in a second condition to transfer hydraulic fluid from said reservoir to the first cylinder space of said one device;

a second auxiliary pump operable in a first condition to transfer hydraulic fluid from the first cylinder space of said other device to said reservoir and in a second condition to transfer hydraulic fluid from said reservoir to the first cylinder space of said other device;

the displacement of the pumps being such that the ratio of the sum of the displacement of a main pump and an auxiliary pump to the displacement of the main pump is equal to the ratio of the cross sectional area of said first cylinder space to the cross sectional area of said second cylinder space; and means for operating all of said pumps in unison whereby when all of said pumps are operative in respective first conditions said piston rods are retracted and when all of said pumps are operative in respective second conditons said piston rods are extended, while any torque couple on said common output member is maintained.

* * * * *

UNITED STATES PATENT AND TRADEMARK OFFICE

CERTIFICATE OF CORRECTION

PATENT NO. : 4,342,164

DATED : August 3, 1982

INVENTOR(S) : Josephus A.M.Claassen

It is certified that error appears in the above-identified patent and that said Letters Patent are hereby corrected as shown below:

On the Title page

---[30] Foreign Application Priority Data

Netherlands application 77.05104 filed May 9, 1977.---

Signed and Sealed this

*Twenty-first* Day of *September 1982*

[SEAL]

*Attest:*

GERALD J. MOSSINGHOFF

*Attesting Officer*

*Commissioner of Patents and Trademarks*